US009435561B2

(12) United States Patent
Bowen

(10) Patent No.: US 9,435,561 B2
(45) Date of Patent: Sep. 6, 2016

(54) PROTECTIVE HVAC COVER

(71) Applicant: Adam Bowen Intellectual Property, LLC, Guyton, GA (US)

(72) Inventor: Adam Bowen, Guyton, GA (US)

( * ) Notice: Subject to any disclaimer, the term of this patent is extended or adjusted under 35 U.S.C. 154(b) by 0 days.

(21) Appl. No.: 14/668,653

(22) Filed: Mar. 25, 2015

(65) Prior Publication Data

US 2015/0338125 A1 Nov. 26, 2015

Related U.S. Application Data

(60) Provisional application No. 62/000,797, filed on May 20, 2014.

(51) Int. Cl.

| | |
|---|---|
| ***F25D 23/12*** | (2006.01) |
| ***F24F 13/20*** | (2006.01) |
| ***F24F 1/06*** | (2011.01) |

(52) U.S. Cl.

CPC *F24F 13/20* (2013.01); *F24F 1/06* (2013.01)

(58) Field of Classification Search

CPC .... B65D 81/3886; B65D 25/34; A61G 5/10; B62D 1/06; E04G 21/30

USPC ..... 150/154–168; 119/474; D6/610–612; D23/354, 286; 62/507, 259.1; 55/493, 55/491; 52/79.5, 473; 206/523, 326

See application file for complete search history.

(56) References Cited

U.S. PATENT DOCUMENTS

| | | | | |
|---|---|---|---|---|
| 4,815,530 | A * | 3/1989 | Scott | F24F 13/20 165/134.1 |
| 5,158,486 | A * | 10/1992 | Tamame | F24F 13/20 160/368.1 |
| 5,311,813 | A * | 5/1994 | Fairbanks | A47J 47/005 135/126 |
| 6,158,175 | A * | 12/2000 | Carter | F24F 1/58 52/23 |
| 6,401,474 | B1 * | 6/2002 | Wigglesworth | F04D 25/14 62/259.1 |
| 6,772,826 | B1 * | 8/2004 | Barnett | F24F 1/06 165/134.1 |
| 8,429,922 | B2 * | 4/2013 | Freeman | F24F 5/0089 454/250 |
| D702,330 | S * | 4/2014 | Holslin | D23/286 |
| 8,726,954 | B2 * | 5/2014 | Simmons | B01D 46/10 114/361 |
| 2007/0204945 | A1 * | 9/2007 | Ross | F24F 1/50 150/165 |

* cited by examiner

*Primary Examiner* — Fenn Mathew
*Assistant Examiner* — Cynthia Collado

(57) ABSTRACT

This disclosure provides for a protective cover for outdoor HVAC condensers. The protective cover generally comprises a protective covering material, a flexible wire within the protective covering material to allow the protective covering material to conform to any shape or size of HVAC condenser, a hinge mechanism and a strap to prevent the protective cover from being blown over during use and to return to its original position after use to protect the HVAC condenser from debris and natural wear.

17 Claims, 4 Drawing Sheets

PROTECTIVE HVAC COVER

CROSS-REFERENCE TO RELATED APPLICATIONS

This application claims the benefit of U.S. Provisional Application Ser. No. 62/000,797, filed May 20, 2014, and is incorporated herein in its entirety.

STATEMENT REGARDING FEDERALLY SPONSORED RESEARCH OR DEVELOPMENT

Not applicable

REFERENCE TO A SEQUENCE LISTING, A TABLE, OR A COMPUTER PROGRAM, LISTING COMPACT DISC APPENDIX

Not applicable

BACKGROUND OF THE INVENTION

1. Field of Invention

The present disclosure generally relates to protective HVAC condenser covers that shield an HVAC condenser from sun, rain and debris. More particularly, the present disclosure relates to an HVAC condenser cover that is customizable to any HVAC condenser.

2. Description of Prior Art

Many residential and commercial structures, especially in warm weather climates, are equipped with central air conditioning. These units generally comprise an indoor and an outdoor component where the outdoor component comprises condenser unit. The condenser units typically contain a heat exchanger to cool and condense coolant vapor into liquid, a compressor to raise the pressure of the coolant and push the coolant through the condenser system, and a fan for blowing outside air through the heat exchanger to lower the temperature the inside coolant.

During use, the condenser unit typically produces undesirable heat. This heat is typically removed by a fan that blows outside air through the condenser in order to get rid of the excess heat. In many condenser units, the fans release exhaust out of the top condenser unit through a fan discharge opening or exhaust area.

Many condensers therefore contain a grating or other structure covering the exhaust area to prevent this area from accumulating debris such as dirt, leaves, twigs, snow or ice that can otherwise clog the exhaust area, thereby reducing the efficacy of the condenser unit.

This has led to the development of protective covers to prevent such debris and other natural elements from degrading the workings of the condenser unit. Moreover, many of these covers are designed to solely cover the fan exhaust area. While many of these devices are useful in preventing the accumulation of debris in the condenser, they do suffer from some drawbacks. For example, many of these protective covers require manual removal to allow the condenser to blow out the exhaust, then require the user to again manually place the protective cover back over the condenser unit when not in use. Another disadvantage to these devices is that they fit poorly around the exhaust area, thereby allowing some debris, moisture and other particles to enter the condenser.

Accordingly, there is a need for a device that protects a condenser from debris and the outside elements with little to no attention from the user. The present disclosure addresses this need.

SUMMARY OF THE INVENTION

Embodiments of the present disclosure provide for a method and apparatus for protecting an HVAC condenser top area including the exhaust area from various debris such as leaves, sticks, dirt, as well as providing protection against snow, rain, moisture and ultraviolet radiation. Moreover, the HVAC condenser cover is configured to cover the entire condenser top, thereby eliminating the need for a condenser cover that is specifically adapted to fit over an exhaust area.

In some aspects of the disclosure, there is provided a protective cover for an outdoor HVAC condenser unit comprising a substantially flat, flexible surface covering material, a hinge mechanism and a strap where the surface covering material contains a flexible wire at the outer edge of the surface covering material. A hinge mechanism is fixedly attached to the surface covering material and also containing a means for securing the hinge mechanism to the condenser unit. At least one flexible strap is fixedly attached at one end to the surface covering material and an opposite end of the strap has a means to secure the strap to the condenser unit, allowing the the protective cover to be lifted off the condenser unit by exhaust from the condenser unit when in use and then returns to the surface of the condenser unit, covering the exhaust opening when the condenser is not in use.

In some embodiments, the surface covering material is Mylar or vinyl coated polyester.

In other embodiments, the surface cover material is a one-way breathable material that can be, for example, solution dyed acrylic fabrics and solution dyed polyester fabrics such as Surlast® or Weathermax®.

In some embodiments, the flexible wire is made of a metal or metal alloy such as, for example, aluminum. In other instances, the flexible wire is made of Aluminum 1100 Soft Temper Solid Wire. Moreover, the flexible wire can be located in a pocket within the surface covering material that is disposed substantially along all of the outer edge of the surface covering material.

The hinge mechanism is fixedly attached to the surface covering material and has a means for removable securing the hinge to a condenser unit. In some embodiments, the means for securing the hinge to the condenser unit is at least one magnet or magnetic strip and in some embodiments, at least 3 magnets. The magnets can be located in an internal pocket within the hinge mechanism.

The protective cover also contains a strap that is of sufficient length to allow the protective cover to pivot at the hinge mechanism to about 90°. In some embodiments, the strap is adjustable. In further embodiments, the strap has a means to secure the free end of the strap to the condenser unit that is a hook, clasp or carabineer. In some embodiments, the means for attaching the strap is an S-shaped carabineer. In other embodiments, the strap is positioned substantially opposite of the hinge mechanism.

In some embodiments, the outer edge of the surface covering material has a binding material that is disposed about the outer edge of the surface covering material.

The present disclosure further provides for a method of preventing the accumulation of debris in an outdoor condenser through an exhaust opening of the condenser, the method comprising applying the protective cover as disclosed herein to a surface of a condenser unit, thereby covering an exhaust area.

These and other exemplary features and advantages of the present invention will become clear from the following description with reference to the accompanying drawings.

BRIEF DESCRIPTION OF THE DRAWINGS

The following drawings form part of the specification and are included to further demonstrate certain embodiments or various aspects of the invention. In some instances, embodiments of the invention can be best understood by referring to the accompanying drawings in combination with the detailed description presented herein. The description and accompanying drawings may highlight a certain specific example, or a certain aspect of the invention. However, one skilled in the art will understand that portions of the example or aspect may be used in combination with other examples or aspects of the invention.

DETAILED DESCRIPTION OF THE INVENTION

Figure 1:
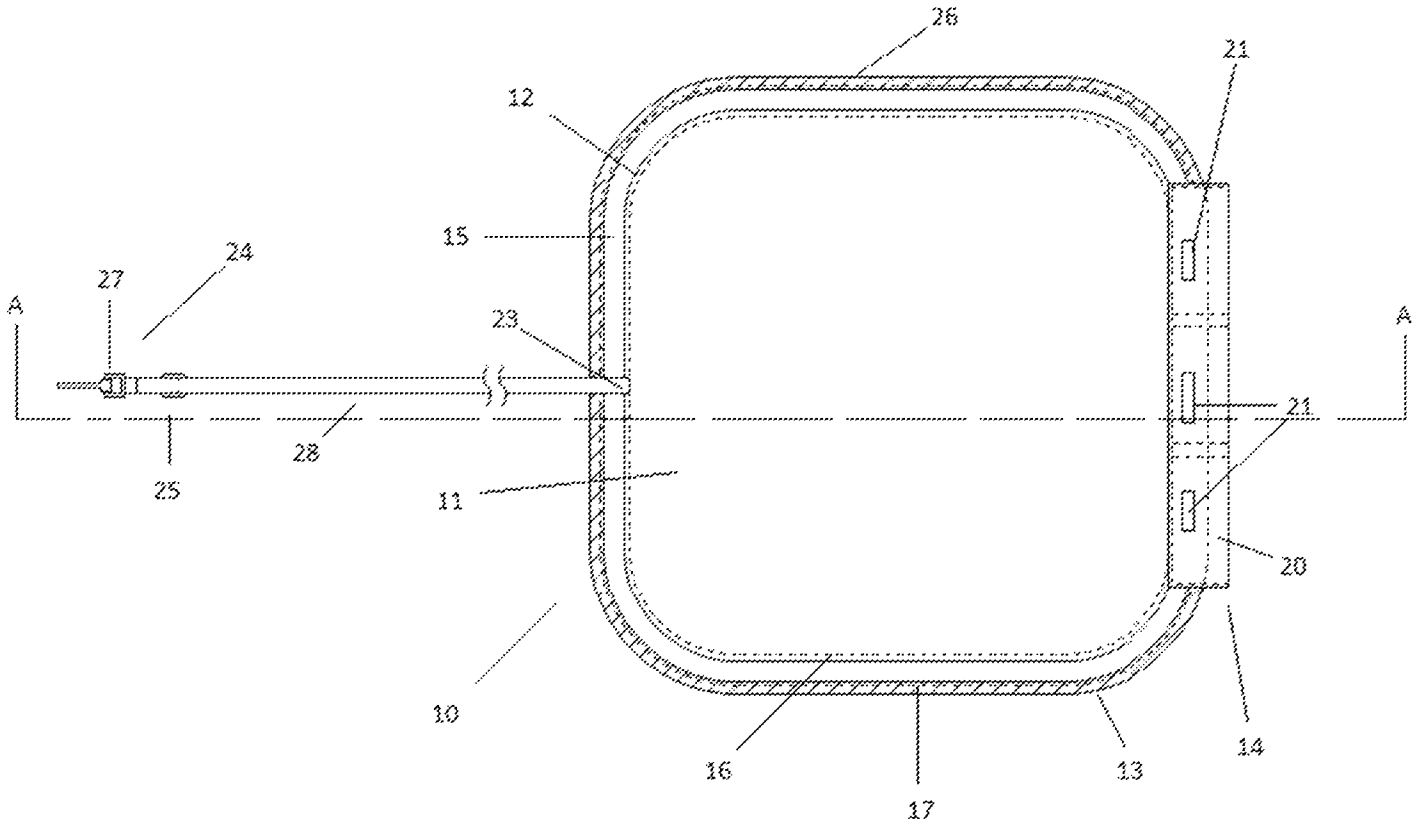
FIG. 1 is a bottom view of an embodiment of the disclosure.

Heating, ventilating, and air conditioning system (hereinafter "HVAC") generally have an indoor and outdoor component, with the outdoor component being a condenser. The condenser units, being outside and exposed to various weather elements can, over time, accumulate debris that can clog the condenser, as well as develop substantial wear from the natural environment. Accordingly, there is a need for a device that can protect the condenser, and specifically the air intake/exhaust fan from the natural elements and debris. The present disclosure addresses this problem.

There is provided herein an HVAC cover apparatus and method of use where the HVAC cover protects the HVAC condenser unit from damaging ultraviolet radiation in the UV-A/UV-B spectrum, precipitation, and other outdoor debris. Moreover, the HVAC cover forms a breathable yet insulating layer that can keep the internal mechanical and electrical components up to 25° C. cooler than ambient temperature. The aforementioned HVAC cover may also increase the life span of these components by significantly reducing rust and corrosion.

Furthermore, the protective HVAC cover can be adapted to fit any condenser unit top or exhaust area thereof where, once attached to the condenser, the HVAC cover can be blown out of the way by the condenser exhaust and return to place after the exhaust stops, thus eliminating any further attention by the user. The low profile of the protective HVAC cover also reduces the chance of being blown off in inclement weather, and does not make the condenser appear bulky or aesthetically unappealing.

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Referring now to FIGS. 1-5, there is shown a view of an HVAC protective cover 10 of the present disclosure, wherein the device is shown in an exemplary embodiment. In some embodiments of the present disclosure, the HVAC protective cover 10 generally comprises a surface covering material 11 that fits over the condenser unit top and covers the exhaust area, a flexible wire 12 within the outer edge 13 of the surface covering material 11 that can be shaped to fit any HVAC condenser unit. The protective HVAC also generally contains a retaining mechanism that tethers the HVAC protective cover 10 to the condenser such that the protective cover 10 is not blown away by the condenser exhaust and allows the cover to return to place. The protective cover 10 also contains a hinge mechanism 14 that allows the protective cover 10 to pivot when the condenser blows exhaust. The hinge mechanism 14 is removably attached to the condenser unit.

The surface covering material 11 is customizable to any type, shape and size of a HVAC condenser top. The surface covering material 11 forms a protective barrier against the elements and other natural debris that may otherwise clog the HVAC condenser. Many condenser tops have a generally circular, square, rectangular, oval or other shape and have an exhaust area therein. The surface material can be adapted to fit over theses shapes and any other condenser top having an exhaust area. In some embodiments, the surface covering material 11 is generally square shaped and can have the dimensions of about 20"×40", or about 24"×24", about 27"×27", or about 30"×30" or about 35"×35".

Moreover, the surface covering material 11 is flexible enough such that it can cover an exhaust fan and other HVAC parts in the exhaust areas that may protrude above the general top surface of the condenser.

The surface covering material 11 is preferably made of a flexible, weather resistant material such as, for example, natural or synthetic latex, polyurethane, or various natural or synthetic rubber materials, malleable plastics, Mylar or vinyl coated polyester. The surface covering material 11 is preferably resistant to UV-A/UV-B radiation. In some embodiments, the protective covering material is made of vinyl coated polyester resistant to UV-A/UV-B wavelengths.

In other embodiments, the surface covering material 11 is a one-way breathable material. In some embodiments, the surface covering material 11 is a one-way breathable material such as a solution dyed acrylic or polyester fabric. In further embodiments, the one-way breathable material is, for example, Surlast® or Weathermax®, which allows moisture in the condenser to escape while preventing outside moisture from getting into the condenser when the protective cover 10 is resting on the surface of the condenser.

The surface covering material 11 also contains a flexible wire 12 in the outer edge 13 of the surface covering material 11. The flexible wire 12 is preferably integral to the surface covering material 11 and allowing for enough flexibility to mold or shape the flexible wire 12, and therefore the surface covering material 11 so as to fit any shape or size of HVAC condenser exhaust area. In some embodiments, the flexible wire 12 is molded into the protective cover 10. In other embodiments, such as when the surface covering material 11 is Mylar, vinyl coated polyester or similar materials, or a solution dyed acrylic or polyester material, the flexible wire 12 may be stitched into, heat sealed or otherwise captured within the surface covering material 11. In other embodiments, the outer edge 13 of the surface covering material 11 has a wire pocket 15, preferably created through stitching or heat sealing to hold the flexible wire 12. In some embodiments, the wire pocket 15 is about 1.5" wide where the wire pocket 15 is defined by a first inner row of stitching 16 and a second outer row of stitching 17. The wire pocket 15 is disposed along all or substantially all of the outer edge 13 of the surface covering material 11.

The surface covering material 11 may have further binding material on some, all or substantially all of the outer edge 13 of the surface covering material 11 for increased strength and resistance to wear. The binding material can be the same material as the surface covering material 11 or different.

In some embodiments, the binding material sandwiches the outside edge of the surface covering material 11. That is to say, the surface covering material 11 is between and upper binding layer 18 and a lower binding layer 19. The binding material 26 can cover the outside edge of the protective cover material. In further embodiments, the binding material can cover at least the outer row of stitching 17 of the wire pocket 15. In still further embodiments, the binding material can cover about a 0.5" width of the outside edge of the surface covering material 11.

In still further embodiments, the flexible wire 12 can be removed from the surface covering material 11 (such as when the flexible wire 12 is stitched into the surface covering material 11) for replacement.

The flexible wire 12 is preferably made of a flexible metal or alloy thereof. In some embodiments, the flexible wire 12 is made of aluminum. In still further embodiments, the flexible wire 12 is made of Aluminum 1100 Soft Temper Solid Wire. In other embodiments, the flexible wire 12 lines the entire or substantially the entire outer edge 13 of the surface covering material 11. In other embodiments, the flexible wire 12 has a diameter of about ¼".

Figure 3:
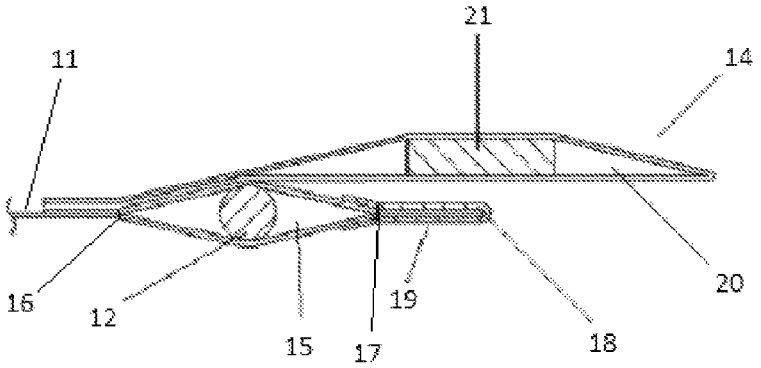
FIG. 3 is side view along the axis A-A of FIG. 1 of a hinge mechanism according to the present disclosure.

As referred to in FIGS. 1 and 3, the surface covering material 11 is attached to a hinge mechanism 14 that allows for the opening and closing of the protective cover 10 over the exhaust opening while also simultaneously having a means for removably securing the hinge mechanism 14 to the condenser unit.

The hinge mechanism 14 is generally rectangular in shape but can be adapted to any type of shape as needed to accommodate the protective cover 10. The hinge mechanism 14 can be made of the same type of material as the surface covering material 11 such as, natural or synthetic latex, polyurethane, or various natural or synthetic rubber materials, malleable plastics, Mylar or vinyl coated polyester, solution dyed acrylic fabric, solution dyed polyester fabric, Surlast® or Weathermax®. In some embodiments, the hinge is made of Mylar or vinyl coated polyester. The hinge mechanism 14 is also preferably UV-A/UV-B resistant.

In some embodiments, the hinge mechanism 14 can be removably secured to the condenser unit using various types of fasteners such as screws, double-sided tape, Velcro® or Velcro® like material, magnets, magnetic strips, polymeric magnetic material or other magnetic fasteners. In some embodiments, the fasteners are magnets 21.

In some hinge mechanisms 14, the magnetic fasteners are magnets 21 that fit within pockets 20 in the hinge mechanism 14. The hinge mechanism 14 can contain about 1-10 magnets, about 1-5 magnets, about 1-3 magnets, or preferably 3 magnets. However, it is contemplated that more than 10 magnets can be used. Generally, the magnets 21 are in a linear arrangement within the hinge mechanism 14.

In some embodiments, the magnets 21 have the dimensions of about 4"×2"×½" to about ½"×½"×¼". In other embodiments, the magnets have the dimensions of 2"×½"×"¼". In some embodiments, the magnets 21 may have the dimensions of 1"×½"×½". In still further embodiments, the magnets 21 are a combination of these sizes. For example, a hinge mechanism 14 may have three magnets where two of the magnets have the dimensions of 2"×½"×¼" and a third magnet with the dimensions of 1"×½"×¼". Moreover, is some embodiments, it may be advantageous to arrange the magnets of different sizes such that the 2"×½"×¼" magnets are on opposite sides of the 1"×½"×¼" magnet. The magnets 21 are generally evenly spaced within the hinge mechanism 14.

The magnets 21 in the hinge mechanism 14 can be separated into individual pockets 20 adapted to fit each magnet. In other embodiments, the magnets 21 are all located in one pocket 20. The pockets 20 can be made, for example, by die cut heat sealing, stitching or double stitching applied substantially perpendicular to the length of the hinge mechanism 14. In some embodiments, the stitching or heat sealing used to make the pockets 20 is about ½" in width.

In some embodiments, magnets are held in place by the pocket 20 itself, which is adapted to fit snugly around the magnetic fastener. In other embodiments, the pocket 20 is about ¼"-½" longer than the magnet 21 so that the magnets can be manipulated by the user for universal application. In other embodiments, the magnetic fasteners can be held in place in the pocket 20 by an adhesive applied to at least one side that secures the magnetic fastener to the lining of the pocket 20.

In some embodiments, the hinge mechanism 14 has a general length of about 10'-30". In other embodiments, the hinge mechanism 14 is about 10", about 15", about 17", about 20" or about 23". In other embodiments, the hinge mechanism 14 has substantially the same length of the side of the protective cover 10 to which it is attached.

The protective cover 10 may also have a strap that is configured to allow movement of the protective cover 10. For example, when the condenser unit is active and putting out exhaust, the strap restricts the upward movement of the protective cover 10 and prevents the protective cover 10 from being blown of the condenser. In doing so, the strap then allows the protective cover 10 to return to its original position when the condenser stops blowing exhaust.

Preferably, the strap is positioned opposite the hinge mechanism 14, but it can alternatively be placed in various positions about the perimeter of the protective cover 10. The strap is preferably made of nylon or similar material.

In some embodiments, the strap is of sufficient length to allow the protective cover 10 to pivot about 85-90° before the strap becomes taught and restricts further upward movement. Preferably, the strap allows the protective cover 10 to pivot about 90°. In still further embodiments, the strap allows the protective cover 10 to pivot 90° before upward movement is restricted.

Figure 4:
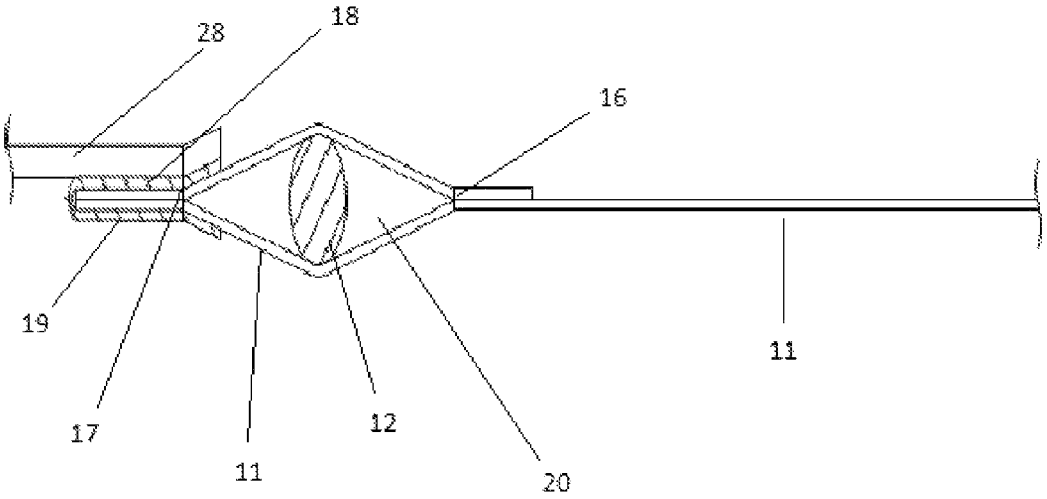
FIG. 4 is a side view along the axis A-A of FIG. 1 of the strap/protective cover interface according to the present disclosure.

As can be seen in FIGS. 1 and 4, in some embodiments, the strap is preferably located at the center point 22 of the side opposite the hinge mechanism 14. One end 23 of the strap is preferably secured to the surface covering material 11 though stitching or double stitching. The strap is preferably about 1" in width and more preferably about ¾" in width. Furthermore, the strap is preferably attached to the bottom of the surface covering material 11 via stitching, and more preferably is attached over the binding material covering at least a portion of the surface covering material 11.

Figure 2:
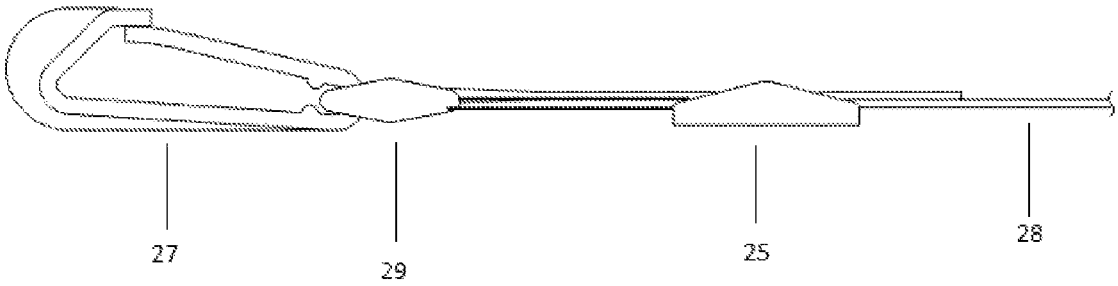
FIG. 2 is a side view along the axis A-A of FIG. 1 of a fastener and buckle mechanism according to the present disclosure.

In some embodiments, the strap 28 has a fastener 27 at the end opposite that which is attached to the protective cover 10 (see FIG. 2). The fastener can be of any type of fastener such as hooks, clips, clasps, loops, latches or carabineers (e.g. D-shaped, S-shaped, oval etc.). In one embodiment, the fastener can be an S-shaped carabineer. The fastener maybe directly attached to the strap, or the fastener may be attached to the strap through an adapter such as a ring, loop or similar structure. The fastener 27, buckle 25 and adapter 29 are preferably made of a durable plastic or metal material.

The fasteners can be used to secure the free end 24 of the strap to the condenser unit. The strap, now secured to the condenser, allows the protective cover 10 to pivot at the hinge when exhaust is blown out, but prevents the protective cover 10 from being completely blown off the condenser or fold back on itself. Instead, the strap stops the protective cover 10 from pivoting past a predetermined length set by the user. For example, the strap can allow the protective cover 10 to pivot to an angle up to about 30°-90°, about 45°-90°, about 60°-90°, about 75°-90°, about 85°-90°, about 90° or 90°. In some embodiments, the strap allows the protective cover 10 to pivot to a 90° angle.

In some embodiments, the strap is adjustable to allow the user to adjust the angle at which the protective cover 10 can pivot and to fit different sized protective covers (e.g. a large protective cover may require a longer strap length to allow the protective cover to pivot to a desired angle). The strap may be adjustable through a buckle 25, such as a slip buckle or other types of similar devices.

Figure 5:
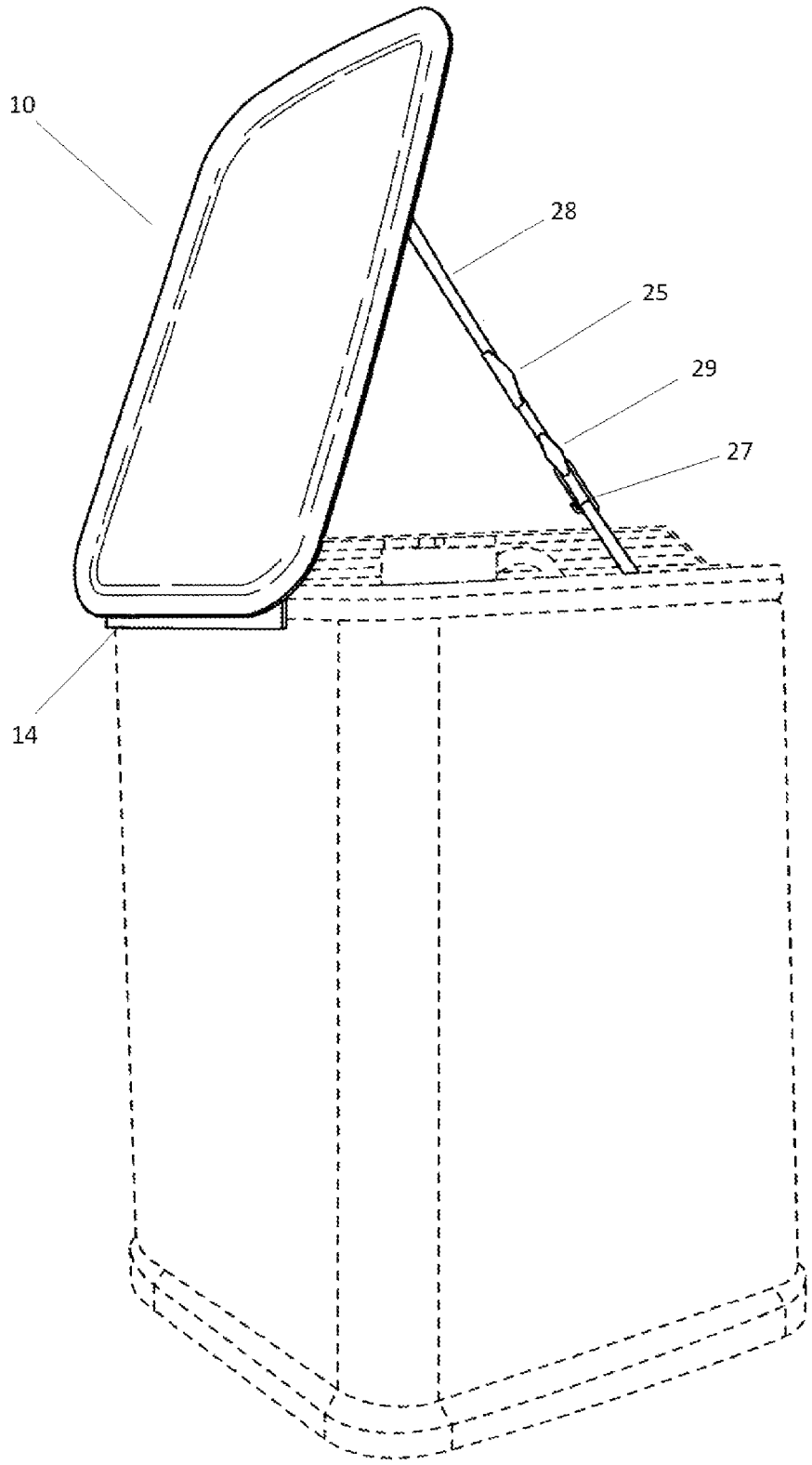
FIG. 5 is a view of an embodiment of the present disclosure in use.

With reference to at least FIG. 5, an embodiment of the present disclosure, having a protective covering 10 of the appropriate size and shape to cover the exhaust area of a condenser unit is shown in use. Preferably, the shape of the protective covering 10 is square or rectangular. The protective covering 10 is laid upon the condenser and the outer edge 13 of the surface covering material 11, with its flexible wire 12, is molded or shaped to fit the contours of the top of the condenser, thereby forming a protective shield against the elements and other debris over the exhaust area. The molding or shaping of the outer edge 13 of the surface covering material 11 by way of the flexible wire 12 is preferably done by the user's own hand. The flexible wire 12 is of a sufficient diameter to allow the user to stretch or push the flexible wire 12 to the contours of the top surface of the condenser.

The hinge portion of the protective cover 10 is arranged so that it lies flat on the condenser unit where the internal magnets 21 are able to removably secure the hinge to the condenser unit, the hinge mechanism 14 being fixedly attached to the surface covering material 11. Opposite the hinge mechanism 14, a strap of sufficient length is attached to the protective cover 10 and is adjusted via an adjustment buckle 25 so that a fastener 27 at the free end 24 of the strap can be secured to the condenser unit such that the during the exhaust cycle, the protective cover 10 is blown off the condenser and pivots to about a 90° angle where it is stopped by the strap. When the exhaust cycle terminates, the protective cover 10 returns to its original position covering the exhaust opening, thereby preventing debris from entering the condenser and protecting the condenser from the natural elements.

Thus, a novel HVAC condenser protective cover has been shown and described. Various changes and substitutions can of course be made without departing from the spirit and scope of the invention.

DEFINITIONS

The following definitions are included to provide a clear and consistent understanding of the specification and claims. As used herein, the recited terms have the following meanings. All other terms and phrases used in this specification have their ordinary meanings as one of skill in the art would understand.

References in the specification to "one embodiment", "an embodiment", etc., indicate that the embodiment described may include a particular aspect, feature, structure, moiety, or characteristic, but not every embodiment necessarily includes that aspect, feature, structure, moiety, or characteristic. Moreover, such phrases may, but do not necessarily, refer to the same embodiment referred to in other portions of the specification. Further, when a particular aspect, feature, structure, moiety, or characteristic is described in connection with an embodiment, it is within the knowledge of one skilled in the art to affect or connect such aspect, feature, structure, moiety, or characteristic with other embodiments, whether or not explicitly described.

The singular forms "a," "an," and "the" include plural reference unless the context clearly dictates otherwise. Thus, for example, a reference to "a compound" includes a plurality of such compounds, so that a compound X includes a plurality of compounds X. It is further noted that the claims may be drafted to exclude any optional element. As such, this statement is intended to serve as antecedent basis for the use of exclusive terminology, such as "solely," "only," and the like, in connection with any element described herein, and/or the recitation of claim elements or use of "negative" limitations.

The term "and/or" means any one of the items, any combination of the items, or all of the items with which this term is associated. The phrase "one or more" is readily understood by one of skill in the art, particularly when read in context of its usage.

As used herein, the term "about" refers to an approximately +/−10% variation from a given value. It is to be understood that such a variation is always included in any given value provided herein, whether or not it is specifically referred to.

One skilled in the art will also readily recognize that where members are grouped together in a common manner, such as in a Markush group, the invention encompasses not only the entire group listed as a whole, but each member of the group individually and all possible subgroups of the main group. Additionally, for all purposes, the invention encompasses not only the main group, but also the main group absent one or more of the group members. The invention therefore envisages the explicit exclusion of any one or more of members of a recited group. Accordingly, provisos may apply to any of the disclosed categories or embodiments whereby any one or more of the recited elements, species, or embodiments, may be excluded from such categories or embodiments, for example, for use in an explicit negative limitation.

What is claimed is:

1. A protective cover for an outdoor HVAC condenser unit comprising:

a substantially flat and flexible surface covering material, a hinge mechanism and a strap;

wherein the surface covering material having a flexible wire at an outer edge of the surface covering material; and a hinge mechanism fixedly attached to the surface covering material wherein the hinge mechanism contains a means for removably securing the hinge mechanism to the condenser unit wherein the means for removably securing the hinge mechanism to the condenser unit is at least one magnet or magnetic strip, and wherein the at least one magnet or magnetic strip is located in an internal pocket within the hinge mechanism; and at least one strap fixedly attached at one end to the surface covering material and an opposite end of the strap having a means to secure the strap to the condenser unit wherein the protective cover is lifted off the condenser unit by exhaust from the condenser unit when in use and returns to a surface of the condenser unit covering an exhaust opening when not in use.

2. The protective cover of claim 1 wherein the surface covering material is Mylar or vinyl coated polyester.

3. The protective cover of claim 1 wherein the surface covering material is a one-way breathable material.

4. The protective cover material of claim 3 wherein the one-way breathable material is a solution dyed acrylic or polyester fabric.

5. The protective cover of claim 1 wherein the flexible wire is made of a flexible metal or metal alloy.

6. The protective cover of claim 5 wherein the metal or metal alloy is Aluminum.

7. The protective cover of claim 6 wherein the flexible wire is made of Aluminum 1100 Soft Temper Solid Wire.

8. The protective cover of claim 1 wherein the flexible wire is located within an internal pocket disposed along substantially all of the outer edge of the surface covering material.

9. The protective cover of claim 8 where the at least one magnet comprises at least 3 magnets.

10. The protective cover of claim 1 wherein the strap is of sufficient length to allow the protective cover to pivot at the hinge mechanism to about 90°.

11. The protective cover of claim 1 wherein the strap is adjustable.

12. The protective cover of claim 1 wherein the means to secure the opposite end of the strap to the condenser unit is hook, clasp or carabineer.

13. The protective cover of claim 12 wherein the carabineer is an S-shaped carabineer.

14. The protective cover of claim 1 wherein the strap is positioned substantially opposite of the hinge mechanism.

15. The protective cover of claim 1 wherein the outer edge of the surface covering material has a binding material disposed about substantially all of the outer edge of the surface covering material.

16. The protective cover of claim 1 wherein the flexible wire is molded to fit a contour of the condenser unit exhaust area.

17. A method of preventing the accumulation of debris in an outdoor condenser through an exhaust opening of the condenser, the method comprising:

providing a protective cover, wherein the protective cover comprises:

a substantially flat and flexible surface covering material, a hinge mechanism and a strap;

wherein the surface covering material having a flexible wire at an outer edge of the surface covering material; and a hinge mechanism fixedly attached to the surface covering material wherein the hinge mechanism contains a means for removably securing the hinge mechanism to the condenser unit, wherein the means for removably securing the hinge mechanism to the condenser unit is at least one magnet or magnetic strip, and wherein the at least one magnet or magnetic strip is located in an internal pocket within the hinge mechanism; and at least one strap fixedly attached at one end to the surface covering material and an opposite end of the strap having a means to secure the strap to the condenser unit wherein the protective cover is lifted off the condenser unit by exhaust from the condenser unit when in use and returns to a surface of the condenser unit covering an exhaust opening when not in use; and applying the protective cover to the surface of the condenser unit, thereby covering an exhaust area.

* * * * *